United States Patent [19]

Bates

[11] 4,014,067

[45] Mar. 29, 1977

[54] CARPET CLEANING IMPLEMENT

[76] Inventor: Charles Ross Bates, 1111 Morse Ave., No. 179, Sunnyvale, Calif. 94086

[22] Filed: June 20, 1975

[21] Appl. No.: 588,729

[52] U.S. Cl. ..... 15/320; 15/322; 15/381; 15/410

[51] Int. Cl.[2] ..... A47L 7/00

[58] Field of Search ..... 5/320, 321, 322, 353, 5/381, 410

[56] References Cited

UNITED STATES PATENTS

| | | | |
|---|---|---|---|
| 2,635,278 | 4/1953 | Belknap | 15/353 |
| 2,731,659 | 1/1956 | Coplen | 15/320 |
| 3,155,996 | 11/1964 | Berthelot et al. | 15/410 X |
| 3,705,437 | 12/1972 | Rukavina, Jr. et al. | 15/322 X |
| 3,747,155 | 7/1973 | Koellisch | 15/321 X |
| 3,828,390 | 8/1974 | Cater | 15/321 |
| 3,883,301 | 5/1975 | Emrick et al. | 15/321 X |

*Primary Examiner*—Christopher K. Moore
*Attorney, Agent, or Firm*—Phillips, Moore, Weissenberger, Lempio & Majestic

[57] ABSTRACT

The invention is concerned with a carpet cleaning implement useful for continuously washing and rinsing a floor fastened carpet in a single operation. The implement includes a head adapted to be rolled along on a carpet upon wheels. The head includes adjacent its bottom a first row of jets for delivering a flow of a solution of a washing composition such as rug shampoo, under pressure, into the carpet. An oscillatory brush is provided near to the first row of jets for vigorously agitating the solution into the carpet. A second row of jets are located near the brush on its other side. The second row of jets serves to deliver a flow of rinse water under pressure into the carpet. Next to the second row of jets is a channel which communicates with a vacuum source of at least about 100 inches of water for picking up the combined solution and rinse water as the head is rolled along the carpet in a direction whereby the first row of jets passes over a portion of the carpet followed sequentially by the brush, the second row of jets and the channel. A handle is provided extending from the head whereby an operator can direct and control the motion of the head over the carpet. A valve is provided on the handle in easy position for operator control. The valve communicates with a liquid source and serves to simultaneously control flow of the solution through the first row of jets and of the rinse water through the second row of jets.

10 Claims, 3 Drawing Figures

CARPET CLEANING IMPLEMENT

BACKGROUND OF THE INVENTION

1. Field of the Invention

The invention is concerned with the art of washing a floor fastened carpet followed by rinsing of the carpet before the solution used to wash the carpet has had time to even start to dry onto the fibers thereof. More particularly the invention is concerned with a rug cleaning implement which in one pass over a portion of a floor fastened carpet not only washes the carpet, as for example by shampooing it, but which also immediately rinses the washed portion of the carpet and picks up the washing composition and the rinse water which has been introduced onto the carpet during the washing and rinsing operation.

2. Prior Art

A number of apparatus are known in the art for washing a floor fastened carpet. For example, rug shampooing machines are often utilized which deliver a premixed solution of a cleaning composition such as a shampoo onto a floor fastened carpet and which then have a brush, such as for example a rotary brush, for agitating the thus wetted carpet to aid in extracting dirt therefrom. Often what results is a carpet with a foam or suds covering. In many cases, the foam or suds are simply allowed to dry into the carpet. In other cases, a vacuum cleaner capable of picking up water is run over the wet and often sudsy carpet and thereby extracts a good deal of the washing solution and, when present, the foam or suds. In such a case, some of the solution remains in contact with the fibers of the carpet since no rinsing occurs. In yet other instances, a rinse machine may be run over the carpet either while the carpet is still wet or after the suds and cleaning solution have dried onto the fibers thereof. Such a rinse machine then delivers a clear rinse liquid, generally water, onto the carpet and then picks up the rinse water along with any washing solution, suds and the like into a vacuum pick-up head.

The best of the prior art methods for cleaning a floor-fastened carpet is then to first introduce and agitate a washing composition, such as a shampoo, into the carpet with a first machine and then, while the carpet is still wet, but after a definite amount of time, generally at least the time necessary to shampoo the entire carpet, to run a second machine over the carpet which rinses the carpet and picks up as much as it can of the water and cleaning compound therefrom. There are, however, several problems with even this best prior art method of operation. First, it requires the use of two separate machines, one for the cleaning or shampooing operation and a second for the rinsing operation. Also, the longer period of time which elapses between the cleaning operation and the rinsing operation, the less efficient is the rinsing operation. This is because at least some of the cleaning compound will have a chance to more thoroughly attach itself through partial or complete absorption and/or adsorption and drying, to or within the fibers of the floor-fastened carpet.

Another problem with carpet cleaning, in particular with the use of shampooing machines, has been that the complete dilute cleaning solution has often been supported by the shampooing machine itself thus requiring significant operator strength to operate, for example, the typical rotary carpet shampooer.

A single implement which would in a single continuous operation supply cleaning solution to a floor fastened carpet, agitate via brushing the cleaning solution into the fibers of the carpet, spray rinse water onto the portion of the carpet which has just been agitated, and immediately pick up the rinse water and cleaning solution together and remove them from the carpet before any drying in at all of the cleaner can have occurred, would be advantageous in that it would provide complete carpet cleaning with cleaner removal by a single machine, thus cutting down the time of cleaning of a carpet as well as the amount of equipment needed by a carpet cleaner and would thereby greater reduce carpet cleaning time, and would provide a carpet more completely free of cleaning composition, while at the same time increasing the useful life of the carpet since less cleaning compound, which might deleteriously affect the fibers of the carpet, would be left behind. The present invention is concerned with a carpet cleaning implement which provides all of these advantages and, in some specific embodiments, other advantages as well.

SUMMARY OF THE INVENTION

The invention is concerned with a carpet cleaning implement useful for continuously washing and rinsing a floor fastened carpet in a single operation. The implement comprises a head adapted to be rolled on a floor fastened carpet upon roller means with a bottom portion of said head facing said carpet, said head including adjacent to said bottom portion first liquid delivery means for delivering flow of a first liquid under pressure into said carpet, brush means adjacent said first liquid delivery means for agitating said first liquid into said carpet, second liquid delivery means adjacent said brush means and on an opposite side therefrom from said first liquid delivery means for delivering a flow of a second liquid under pressure into said carpet and a channel communicating with a vacuum source of at least about 100 inches of water adjacent said second liquid delivery means and on an opposite side therefrom from said brush means for picking up said first liquid and said second liquid as said head is rolled along said carpet in a direction whereby said first liquid delivery means first passes a portion of said carpet followed sequentially by said brush means, said second liquid delivery means and said channel. Also, a part of the carpet cleaning implement is a handle extending from said head for operator control thereof. Further a part of said carpet cleaning implement are valve means on said handle communicating with a liquid source for controlling flow of said first liquid through said first liquid delivery means and flow of said second liquid through said second liquid delivery means.

In a particular preferred embodiment, the first liquid is primarily water and the second liquid comprises a water-based rinse and the implement includes a reservoir for a liquid cleaner concentrate, a first conduit is provided in line from said valve means to said first liquid delivery means and means are provided for introducing said concentrate into said first conduit as said first liquid flows therethrough to thereby form a water-containing cleaner composition.

BRIEF DESCRIPTION OF THE DRAWINGS

The invention will be better understood by reference to the drawings in the figures of which like numbers denote like parts throughout and wherein.

DETAILED DESCRIPTION OF THE PREFERRED EMBODIMENT

Figure 1:
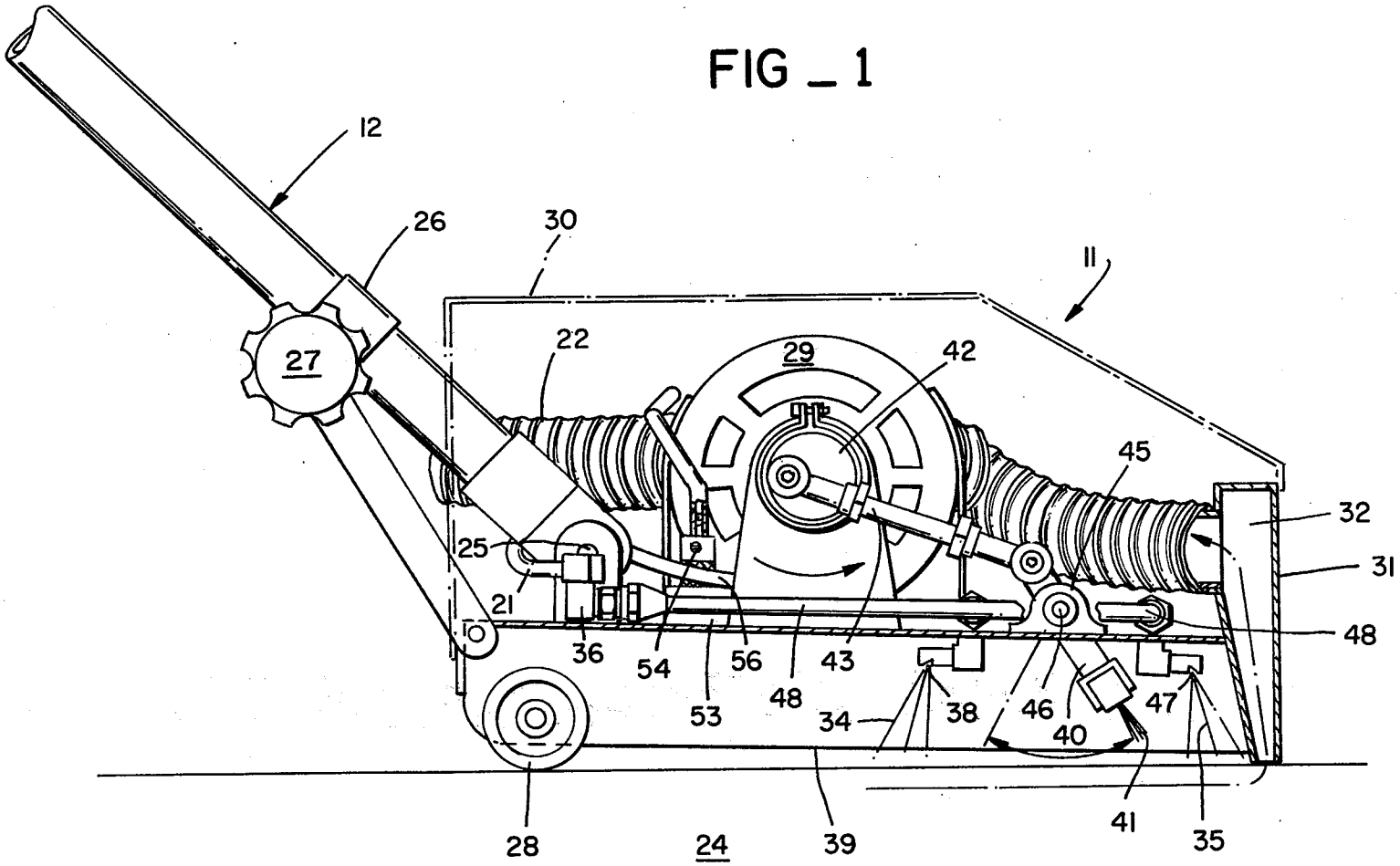
FIG. 1 illustrates in side elevation view, partially cut away, the head of a carpet cleaning implement of the present invention.
Figure 2:
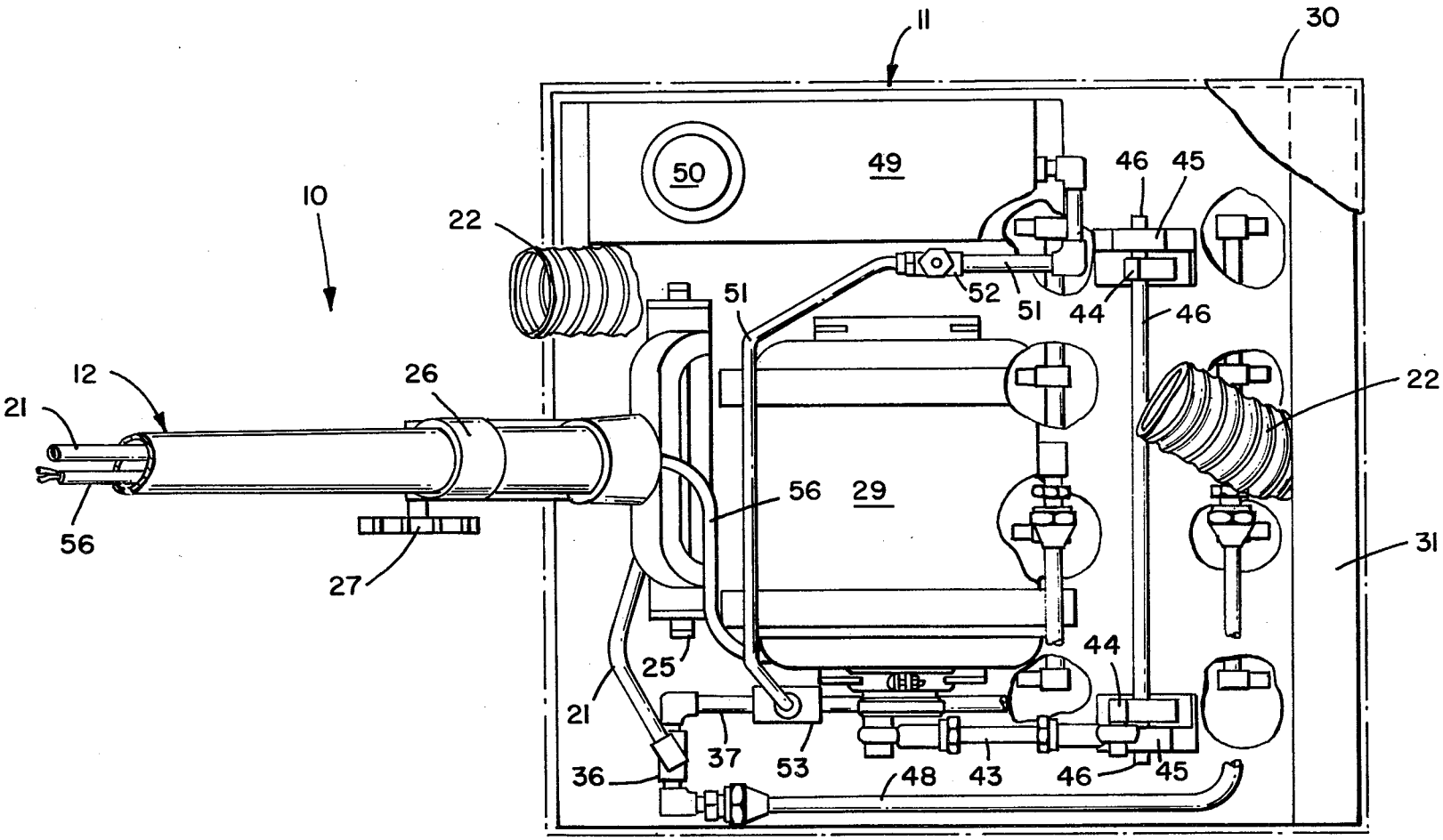
FIG. 2 is a top view, partially cut away, illustrating the head of FIG. 1.
Figure 3:
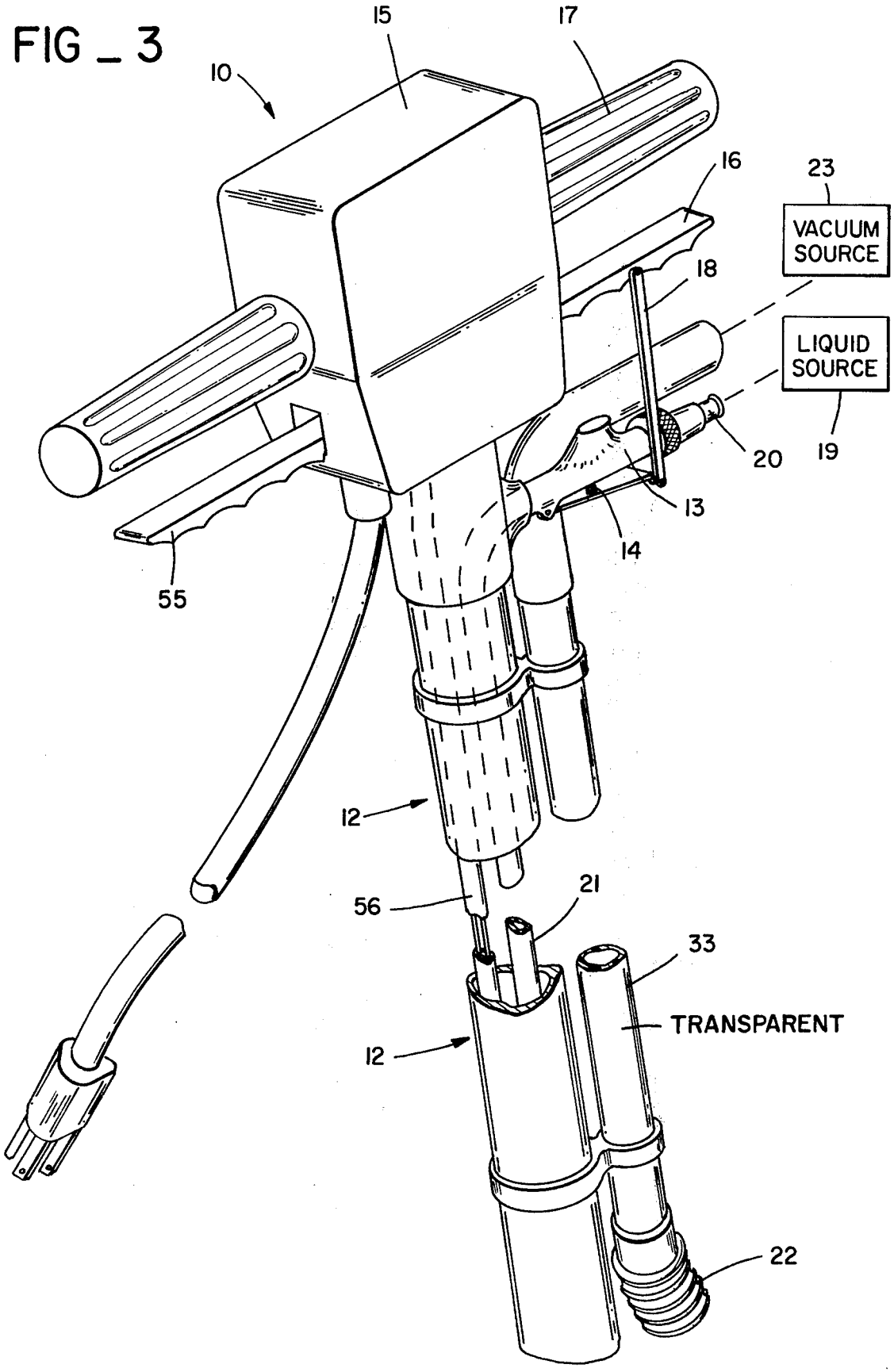
FIG. 3 illustrates in perspective partial view the handle and control portions of the carpet cleaning implement.

The carpet cleaning implement of the present invention is indicated generally by the numeral 10. The implement 10 includes a head 11 shown best in FIGS. 1 and 2 and a handle 12 shown best in FIG. 3 extending from the head 11 for operator control thereof. Valve means, in the preferred embodiment illustrated a valve 13 biased by a spring 14 to be normally shut is located adjacent a top portion 15 of the handle 12 and operated by movement of a lever 16 adjacent a cross member 17 and thereby of a linkage 18, controls flow of a liquid from a liquid source 19 which liquid may be, for example, ordinary tap water taken either directly from a water tap or water with any desired adjuvants, e.g., bleach or the like, therein pumped from a water supply tank, via a liquid supply connector 20 to a liquid delivery conduit 21 made of flexible material such as plastic and downwardly therefrom internally of the handle 12 to the head 11. A flexible vacuum hose 22 is provided communicating with the head 11 and also communicating with a vacuum source 23. The vacuum source 23 must be relatively strong and more particularly must provide a vacuum of at least about 100 inches of water, preferably at least about 120 inches of water, more preferably at least about 130 inches of water and still more preferably at least about 140 inches of water. If a strong vacuum source is not available, the liquids delivered to a floor fastened carpet 24 by the carpet cleaning implement 10 will not be sufficiently picked up so as to prevent the leaving of significant amounts of cleaning solution in the carpet 24. With a vacuum of at least about 130 inches of water, well over 90% of the liquids are picked up.

The handle 12 is rotatably attached to the head 11 at the axle 25 whereby the handle 12 is rotatable in a plane perpendicular to the carpet 24 to provide adjustments for operators of different heights. The handle 12 passes through a sleeve 26 which can be tightened against the handle 12 by twisting a knob 27. The knob 27 is rotatingly attached to the head 11 via a pivoted strut as illustrated. Thus, the handle 12 can be adjusted for an operator of any height and then detachably fastened temporarily in place through use of the knob 27.

A pair of wheels 28 serve as roller means and support the head 11. The wheels 28 are located generally below the axle 25 to which the handle 12 is rotatably attached. A motor 29 mounted generally upon the head 12 for reasons which will later be explained, and a head cover 30, also mounted to the head 11, are generally so located, along with other components of the head 11, whereby the great majority of the weight of the carpet cleaning implement 10 falls upon the wheels 28 to provide easy operator control of said implement 10. The remainder of the weight of the carpet cleaning implement 10 is then supported by an internally channelled member 31 which has an internal channel 32 which is connected with the strong vacuum source 23 via the flexible hose 22. Preferably, attached parallel to the handle 12 is a transparent tube 33 through which picked up cleaning liquid, rinse liquid, suds and the like pass to a vacuum connector and therefrom to the vacuum source 23. The transparent tube 33, which may be made of glass or preferably a transparent plastic material, allows operator observation of the liquid being picked up from the carpet 24. Thus the operator can immediately know whether additional washing or rinsing is necessary (if the picked up liquid is extremely dirty in appearance).

Liquid flowing through the liquid delivery conduit 21 is separated into a first liquid 34 and a second liquid 35 at a T fitting 36. The first liquid 34 travels through a first conduit 37 to a first liquid delivery means, in the embodiment illustrated in the drawings a first plurality of openings (or jets) 38, adjacent a bottom 39 of the head 11. The first liquid 34 is sprayed out of the first plurality of openings 38 under pressure and generally perpendicularly into the carpet 34. As illustrated in the drawings, the first plurality of openings 38 is generally in a straight line so as to deliver a flow of the first liquid 34 along a straight line beneath the bottom 39 of the head 11, said straight line generally being perpendicular to the normal operator initiated motion of the head 11 towards the handle 12 as the operator pulls the handle 12 towards himself.

Adjacent and parallel to the first plurality of openings 38 is an elongated brush 40 having bristles 41 extending therefrom, the bristles 41 being adapted to beat or agitate the first liquid 34 into the carpet 24 as the brush 40 oscillates backwards and forwards as impelled by the rotation of a shaft 42 of the motor 29 to which is attached eccentrically and pivotally rod means 43, said rod means 43 also being attached at an opposite end and pivotally to an extension 44 of the brush 40 removed from the bristles 41, said brush 40 being pivotally mounted between the bristles 41 and the extension 44 to a pair of brackets 45 via a rod 46 whereby as the shaft 42 rotates, the rod means 43 are caused to oscillate thereby importing an oscillatory motion to the extension 44 of the brush 40 which oscillatory motion is tranferred to the bristles 41.

Parallel to and adjacent to the brush 40 and on an opposite side therefrom from the first plurality of openings 38 is a second liquid delivery means which serves to deliver the second liquid 35. In the embodiment illustrated, the second liquid delivery means comprises a second plurality of openings (or jets) 47 from which the second liquid 35 is ejected under pressure generally perpendicularly into the carpet 24. The second plurality of openings 47 are generally parallel to the longitudinal axis of the brush 40 and thereby also parallel to the first plurality of openings 38. The second liquid 35 proceeds to the second plurality of openings 47 via a second conduit 48 which exits the T fitting 36.

Adjacent the second plurality of openings 47 and generally parallel thereto is the channelled member 31 with the channel 32 therewithin. As previously mentioned, the vacuum source 23 is connected to the channel 32 whereby the channel 32 serves for picking up the first liquid 34 and the second liquid 35 along with any suds which might have been developed by the agitation of the carpet 24 from the first liquid 34 as the head 11 is rolled along the carpet 24 upon the wheels 28, the axis of which parallels the brush 40, in a direction whereby the first plurality of openings 38 first passes a portion of the carpet 24 followed sequentially by the brush 40, the second plurality of openings 47 and the channelled member 31 with the channel 32 therewithin.

As stated previously, it is important to the practice of the present invention that the vacuum source 23 to which the channel 32 is connected produce a vacuum at the very least equivalent to 100 inches of water. Even stronger vacuums are highly desirable. For truly efficient operation of the apparatus of the present invention, it is desirable that the vacuum be at least 120 inches of water, more preferably at least 130 inches of water and still more preferably at least 140 inches of water. Basically, the higher the vacuum applied to the channel 32, the greater percentage of the first liquid 34 and the second liquid 35 which are delivered into the carpet 24 are recovered via the channel 32 and thus the lesser amount of cleaning compounds, bleaches or the like which may be added with one or the other of the first liquid 34 and the second liquid 35 are retained in said carpet 24 after the head 11 has passed thereover. The retention of washing solution, bleach or the like in the carpet 24 can lead to an accelerated decomposition thereof and thus complete removal of such compounds is highly desirable. Also, with a strong vacuum available the weight of the head 11 can be distributed over the wheels 28 to allow easy operator pulling of the implement 10 since the strong vacuum assures good contact of the channelled member 31 with the carpet 24.

In a highly preferred embodiment of the present invention the first liquid 34 is water based and in fact is primarily water and will generally include a cleaning compound therein such as a detergent or the like. The second liquid 35 would generally comprise a water based rinse and in most instances would be substantially pure water. A particularly effective way to provide said first liquid 34 as a washing composition is to include as a part of the carpet cleaning implement 10 a reservoir 49 with a cap 50 one or both of said reservoir 49 and cap 50 being vented into which a liquid cleaner concentrate or the like can be added. A tube 51 having a valve 52 therein serves to connect the reservoir 49 with the first conduit 37 and more particularly as means for introducing the concentrate into the first conduit 37 as the first liquid 34 flows through said first conduit 37. The introducing means, as illustrated in the drawing, can generally comprise a venturi injector 53 which operates in a well known and conventional manner whereby the amount of the concentrate introduced is generally proportional to the rate of flow of the first liquid through the first conduit 37 (since the pressure drop across the venturi is determined by the rate of flow of the first liquid 34). The valve 13, as previously mentioned controls the flow of water from the liquid supply connector 20 to the liquid delivery conduit 21 and thence to the T fitting 36, the first conduit 37 and the second conduit 48. Thus, through selectable adjustment of the sizes of the first conduit 37 and the second conduit 48 and of the first plurality of openings 38 and the second plurality of openings 47, adjustment can be made for any desired relative amounts of flow of the first liquid 34 and the second liquid 35. The liquid supply connector 21 connects to the liquid source 19 which can be a typical water tap or a water tank which may be stationary if desired and is located generally separately from the carpet cleaning implement 10. Thus, it is not necessary to premix the liquid cleaner concentrate with water and to carry a premixed tank on the carpet cleaning implement. Also, it is not necessary to premix the concentrate with water to form the washing composition and to carry two separate lines, one from the washing composition to the washing composition delivery member and another from, for example, a water tap or the like to the rinse liquid delivery member with concurrent requirements for extra valving, extra tubing and the like which would lead to crowding increased weight and increased cost.

The valve 52 intermediate the reservoir 49 and the first conduit 37 can be used for roughly metering flow of liquid concentrate out of the reservoir 49 thus allowing the use of liquid concentrates of different concentration of cleaning strength but is primarily useful to completely shut off flow through the tube 51. A metering screw 54 on the venturi 53 generally provides a fine control means for metering liquid concentrate into admixture with the first liquid 34. If the valve 52 is turned off, then only said first liquid 34 is delivered by said first plurality of openings 38 and only said second liquid 35 is delivered by said second plurality of openings 47, and furthermore, said first liquid 34 and said second liquid 35 are of the same composition, generally water. Such a setting can be used when it is desired to use the carpet cleaning implement 10 as a rinse machine alone. This may be desirable for example when a carpet is only slightly soiled or when the carpet has been washed and rinsed as for example by using the carpet cleaning implement 10 of the present invention and wherein it is desired to make especially sure that no washing composition or the like is remaining on the fibers of the carpet 24. In such instances, the valve 52 can be shut off and the carpet cleaning implement 10 can be propelled over the carpet 24 at additional time (or times) over that used in the combined and continuous washing and rinsing operation. This is also useful in flushing out any liquid concentrate from the injector 53, the first conduit 37 and the first plurality of openings 38 after a combined washing and rinsing use thereof to prevent any clogging due to dried liquid concentrate.

Vacuum is supplied to the channel 32 via the flexible hose 22 as by connecting an end of the flexible hose 22 removed from the channel 32 with the vacuum source 23. While a number of conventional vacuum sources can be used or this purpose, it has been found that many of the conventionally used wet vacuum cleaner sources do not develop sufficient vacuum to allow the carpet cleaning implement 20 of the present invention to operate in its most efficient manner. One particularly useful vacuum source which will produce the desired vacuum is disclosed for example in my previous patent entitled Rinse Method and Machine, U.S. Pat. No. 3,848,290, issued Nov. 19, 1974.

Electrical switch operating means 55 are generally provided in easy grip relation to the cross member 17. For safety, the switch operating means 55 are biased so that the motor 29 is off when the switch operating means 55 are not urged towards the cross member 17. The switch operating means 55 provides electrical power to the motor 29 via the cord 56 which passes internally through the handle 12 as illustrated.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertainsand as may be applied to the essential features hereinbefore set forth, and as fall within the scope of the invention and the limits of the appended claims.

That which is claimed is:

1. A carpet cleaning implement useful for continuously washing and rinsing a floor fastened carpet in a single operation, comprising:

a head having a cover thereover, said head being adapted to be rolled along on said carpet upon roller means located adjacent a first end thereof, a bottom portion of said head facing said carpet, said head including adjacent to said bottom portion thereof first liquid delivery means for delivering a flow of a first liquid under pressure onto said carpet, a brush adjacent said first liquid delivery means for agitating said first liquid into said carpet, second liquid delivery means adjacent said brush and on an opposite side therefrom from said first liquid delivery means for delivering a flow of a second liquid under pressure into said carpet and a channel adjacent a second end of said head communicating with a vacuum source of at least about 100 inches of water, said channel being adjacent said second liquid delivery means and on an opposite side therefrom from said brush, said channel serving for picking up said first liquid and said second liquid as said head is rolled along said carpet in a direction whereby said first liquid delivery means first passes a portion of said carpet followed sequentially by said brush, said second delivery means and said channel;

motor means drivingly communicating with said brush to supply oscillatory forwards and backwards motion thereto alternately towards and away from said first and second ends of said head respectively;

a handle extending from said first end of said head for operator control thereof, said motor means, head, first and second liquid delivery means, channel and handle being located so that said roller means supports the great majority of the weight of said implement, said head being normally rolled along said carpet by exertion of a pulling force on said handle;

valve means on said handle communicating with a liquid source for controlling flow of said first liquid through said first liquid delivering means and of said second liquid through said second liquid delivering means.

2. An implement as in claim 1, wherein said first liquid comprises water and said second liquid comprises a water based rinse and including a reservoir for a liquid cleaner concentrate; a first conduit communicating said valve means and said first liquid delivery means and means for introducing said concentrate into said first conduit as said first liquid flows therethrough to thereby form a cleaner composition.

3. An implement as in claim 2, wherein said introducing means comprises a venturi injector whereby the amount of said concentrate introduced is generally proportional to the rate of flow of said first liquid through said first conduit.

4. An implement as in claim 3, including a valve intermediate said reservoir and said first conduit which valve can be used for metering said concentrate and can be shut off thereby causing only said first liquid to be delivered by said first liquid delivery means.

5. An implement as in claim 4, including a liquid delivery conduit intermediate said valve means and said first conduit and a second conduit branching off from said liquid delivery conduit and leading to said second liquid delivery means.

6. An implement as in claim 5, wherein said first liquid delivery means comprises a first plurality of openings arranged in a generally straight line and said second delivery means comprises a second plurality of openings generally parallel to said first plurality of openings.

7. An implement as in claim 6, wherein said handle is mounted to said head so as to be rotatable in a plane perpendicular to said carpet and including means for fastening said handle at a selectable angle from said carpet to provide adjustment for operators of different heights.

8. An implement as in claim 7, wherein said channel defines a generally straight line which is generally parallel to said first and second pluralities of openings and said brush.

9. An implement as in claim 8, wherein said implement includes only one brush.

10. An implement as in claim 9, wherein said motor means includes a shaft and including;

rod means pivotally and eccentrically attached at a first end thereof to said shaft and pivotally attached at a second end thereof to an extension of said brush at a position removed from said brush; and means pivotally mounting said extension to said head intermediate said brush and said pivotal attachment of said extension to said second end of said rod means.

* * * * *